United States Patent [19]

Himmetsberger et al.

[11] Patent Number: 4,681,339

[45] Date of Patent: Jul. 21, 1987

[54] SKI BINDING PART, IN PARTICULAR A FRONT JAW

[75] Inventors: Alois Himmetsberger; Radko Pavlovec; Heinz Wittmann, all of Vienna; Hubert Wuerthner, Hainburg; Tibor Szasz, Vienna; Kurt Liedl, Petronell; Roland Erdei, Pottendorf, all of Austria

[73] Assignee: TMC Corporation, Baar, Switzerland

[21] Appl. No.: 910,317

[22] Filed: Sep. 22, 1986

Related U.S. Application Data

[63] Continuation of Ser. No. 726,522, Apr. 24, 1985, abandoned.

[30] Foreign Application Priority Data

Apr. 27, 1984 [AT] Austria ..... 1419/84

[51] Int. Cl.[4] ..... A63C 9/22

[52] U.S. Cl. ..... 280/633

[58] Field of Search ..... 280/11.16, 11.26, 617, 280/633; 403/322, 325, 330

[56] References Cited

U.S. PATENT DOCUMENTS

| | | | |
|---|---|---|---|
| 3,954,286 | 5/1976 | Weber | 280/512 |
| 4,519,625 | 5/1985 | Luitz et al. | 280/617 |

FOREIGN PATENT DOCUMENTS

| | | | |
|---|---|---|---|
| 288932 | 7/1970 | Austria . | |
| 368394 | 2/1982 | Austria . | |
| 177960 | 6/1935 | Switzerland | 280/633 |
| 469492 | 4/1969 | Switzerland | 280/633 |

*Primary Examiner*—John J. Love
*Assistant Examiner*—Richard Camby
*Attorney, Agent, or Firm*—Flynn, Thiel, Boutell & Tanis

[57] ABSTRACT

A ski binding part, in particular a front jaw, having a guide rail adapted to be fastened to the upper side of a ski and on which is arranged a jaw unit movable in a longitudinal direction of the ski and is secured on a base plate. A housing is provided and a locking mechanism for locking the jaw unit in predetermined sliding positions on the guide rail. The locking mechanism has a locking part which is movably held on the jaw unit and which can be moved by a spring into a form-locking engagement selectively with a complementary locking recess on the guide rail. An operating member is adapted to engage the locking part for effecting a disengagement of the locking part from the complementary locking recess. The operating member is supported on the locking part and is provided with at least two surfaces defining an angle with one another and of which each lies at a different distance from a support point and thus determines the engaged or disengaged position of the locking part. The two surfaces are held pressed on the housing in these positions selectively by the spring.

17 Claims, 5 Drawing Figures

SKI BINDING PART, IN PARTICULAR A FRONT JAW

This application is a continuation, of U.S. Ser. No. 726,522 filed Apr. 24, 1985, now abandoned.

FIELD OF THE INVENTION

The invention relates to a ski binding part, in particular a front jaw, comprising a guide rail which can be fastened on the upper side of a ski and on which is arranged a jaw unit movable in longitudinal direction of the ski and is secured to a base plate, with a housing and a locking mechanism which locks the jaw unit in a predetermined sliding position with the guide rail and which has a locking part which is held movably on the jaw unit and which can be moved by a spring into a form-locking engagement selectively with one of the complementary locking recesses on the guide rail, whereby an operating member, which can be swung upwardly, engages the locking part for disengagement of the locking part from the complementary locking recess.

BACKGROUND OF THE INVENTION

To adjust a ski binding which consists of a front jaw and a heel holder to various shoe sizes, it has been necessary, already for a long time, to design at least one ski binding part to be movable in the longitudinal direction of the ski and to be lockable in predetermined positions. The adjustable ski binding part has for this purpose an adjusting mechanism with a locking mechanism.

The heel holder is in common ski bindings movably guided in general by means of a base plate on a guide rail which can be fastened on the upper side of the ski. The heel holder or its base plate has a releasable notch, whereas the guide rail has an opposing notch. Such a locking mechanism is described for example in Swiss Pat. No. 469 492.

With the increasing demands for the arrangement of ski bindings on the upper side of a ski or skis by the skier, a new demand was, however, also made to shift the center of gravity of the skier and thus the shoes together with the binding forwardly or backwardly relative to an imaginary transverse line on the ski. It has therefore been demanded to now also design the front jaw adjustably in the longitudinal direction of the ski. Since, however, the front jaws usually have a slightly different construction compared with the heel holder, and their function with respect to the holding of the ski shoe differs from the one of the heel holders, it was necessary to develop a new system for adjusting the front jaw of a ski binding.

Flaps have therefore been developed, which permit a disengagement of a locking part from a corresponding locking recess. Such adjusting mechanism have already become known in various forms of construction.

Another type of common locking mechanism is described for example in European AS No. 0084324. A disengagement occurs thereby through a handle part which is manually shifted and through this lifts a leaf spring, which presses a locking pin into a locking recess, after which the jaw can be moved in the longitudinal direction of the ski. If one leaves out the lever, then the locking pin engages the corresponding locking recess and the jaw is fixed in the longitudinal direction of the ski.

This development has, however, together with all other similar lever constructions, a disadvantage, namely, that the jaw adjustment can be carried out only if at the same time a handle part is held. A one-hand operation is thus only possible in a shop (when the shoe is clamped), not, however, on a slope. The change of the center of gravity and thus of the skiing characteristics is, however, also to be assured under these circumstances.

The goal of the invention is now to provide a movable or adjustable front jaw with a locking mechanism, which permits in a comfortable manner a secure engagement and a disengagement through a one-hand operation and, in addition, on the slope.

The set purpose is attained inventively by the operating member being supported on the locking part and being provided with at least two surfaces or surface sections, which define an angle with one another and of which each lies at a different distance from a support point or pin and thus determines the engaged or disengaged position of the locking part, and the two surfaces or surface sections are held or pressed against the housing in these positions selectively by the spring.

It is now possible for the first time through the invention to disengage the locking mechanism through a simple handling of the operating member and to fix it in the unlocked condition, which permits any desired manual movement of the front jaw. Also the re-engagement is very simple.

This effect can thereby be achieved either by the operating member having a support area, on which the operating member is supported during its swivelling on the housing, whereby the support area in the closed or open position of the operating lever is on the one or other side of a plane extending through the centerline of the support point; or by the operating member having a support area which is rotatably supported in the housing, and on which support area is supported the operating member during its pivoting on the housing, whereby the support point or pin is movably arranged through an elongated slot in the locking part or in the operating member and in the closed or open position of the operating member is provided on the one or other side of a plane extending through the support area and defines a preferably right angle with the upper side of the housing.

These two embodiments of the invention permit likewise in an optimum manner to attain advantageously the set purpose, whereby the second embodiment is built slightly smaller, but has more individual structural parts.

The first embodiment is formed according to a further development of the invention at its support area by the merging of the two surfaces, whereby the support area is preferably formed by a rounded area. The further development, according to which the support area is arranged on a vertical climb curve of an eccentric, effects a very simple adjusting of the locking part from the engaged into the disengaged position, whereby the upper side of the housing is substantially protected by the rounded area. The operating member can thereby, as is actually known, be designed itself as an eccentric cam, whereby the locking effect occurs in particular very reliably, as when, in the locked position, the one surface of the operating member lies in a parallel plane and its other surface in a normal plane with respect to the longitudinal center axis of the locking part.

According to another modification, the operating member is a handle connected in one piece to the surfaces and the vertical climb curve. The handle can have any desired shape and can therefore be adjusted at an optimum to the styling of the jaw member.

The handle can for example according to a different special development of the invention be a one-arm lever, the one end of which carries a handle part and the other end of which carries the surfaces and the vertical climb curve.

According to still another development of the invention, the handle can be designed as a rotary button or a rotary roller.

According to a further development of the invention, the handle can be arranged on a shaft, which carries the eccentric.

A form of construction of the locking part which is very reliable in operation and is simple to manufacture, is characterized according to a further development of the invention by the locking part having at its end which faces the base plate a piston carrying the locking pin, and an abutment surface for the spring, which piston is guided in a preferably cylindrical recess of the housing, whereby the housing at a location remote from the guide rail forms an opposing surface for the spring. This form of construction furthermore permits an especially good force transfer between the locking pin and the locking recess, whereby the shearing forces are effectly absorbed by the recess of the housing.

In order to avoid as much as possible the external effects caused by snow, ice, brush etc., it is provided that the operating member in the locked position is at least partially countersunk in the housing. Safety is thereby further increased when the handle part, viewed in the skiing direction, is arranged in front of the support point or pin and extends toward the tail of the ski.

Another particularly advantageous form of the invention is characterized by the support point or pin engaging movably a substantially horizontally elongated slot of the locking part, whereby at least one end of the slot is farther from an imaginary vertical centerline of the locking part than the support area.

According to another development of the invention it is provided, for especially heavy loads, that the locking part is designed twofold and is arranged on both sides of the centerline of the ski.

Another development provides that the handle part can be operated only by a tool, which prevents an unauthorized manipulation by unknowledgeable persons, or at least make such manipulation more difficult.

BRIEF DESCRIPTION OF THE DRAWINGS

The subject matter of the invention will be discussed in greater detail with reference to the drawings, which illustrate several exemplary embodiments.

In the drawings.

DETAILED DESCRIPTION

Figure 1:
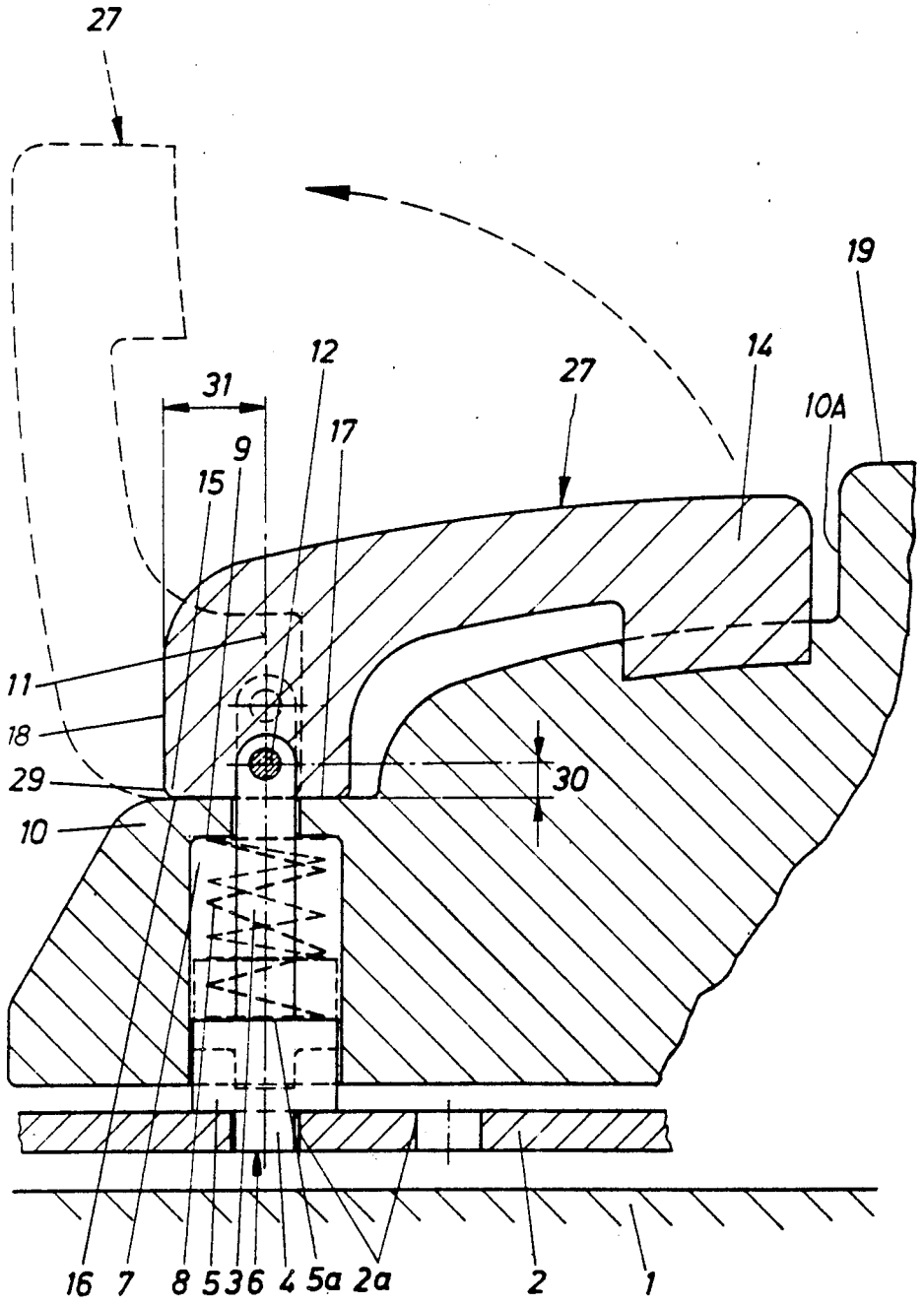
FIG. 1 is a cross-sectional view of an inventive locking mechanism having a leverlike handle part.

The inventive exemplary embodiment according to FIG. 1 is designed as follows:

A guide rail 2 is secured in a manner which is not illustrated in detail to the upper side of a ski 1. The guide rail 2 has locking recesses 2*a* each adapted to receive a locking bolt 4 therein. The locking bolt 4 is connected in one piece to a piston 5, which in turn is provided with a guide rod 3 which extends in a direction opposite the locking bolt 4, so that the locking bolt 4, piston 5 and guide rod 3 together form a locking part 6. The piston 5 is guided axially in a recess 7 in a housing 10. The guide rod 3 is guided through a passageway in the housing 10 to the outside, which passageway has a smaller diameter than the recess 7. Thus a cavity is created between the boundary of the recess 7, remote from the guide rail 2 and the upper side of the piston 5, which is also remote from the guide rail 2. A spiral spring 8 is arranged in this cavity and is supported thus at the one end thereof on an abutment surface 5*a* formed by the upper side of the piston 5, and at the other end thereof on an opposing surface 9 formed by the housing namely, the bottom of the recess, and loads the piston 5 in an axial direction. The locking part 6 and thus the locking bolt 4 is pressed at all times against the guide rail 2 by the spring 8.

The part of the guide rod 3 which projects from the housing 10 has a point of engagement, namely, a pin 12, which is supported on an operating member 27. The operating member 27 is here designed as a handle having a handle part 14, whereby the support point or pin 12 for the locking part 6 is provided at the end which lies opposite the handle part 14. This end of the operating member 27 has furthermore a surface 17 which, in the illustrated locking position, rests flat on the upper side 16 of the housing 10. A further surface 18 extends at a right angle to the surface 17 and is contiguous with the surface 17 through a vertical climb curve 15 of an eccentric. The support area 29, through which the operating member 27 can be changed around, lies on the vertical climb curve 15. During a changing around of the operating part 27 through the support area 29 into the position illustrated by dashes in FIG. 1, the support area 29 slides on the upper side 16 of the housing 10 in direction of the centerline 11 through the support point or pin 12. As soon as this support area 29 passes a plane through the centerline 11 and containing the axis of the pin 12, the operating part 27 is again in a stable position, so that now the side 18 rests on the upper side 16 of the housing 10, as this is illustrated in the dashed position of the operating member 27 in FIG. 1. The effect of an engaging or disengaging is accomplished in this embodiment by the support point or pin 12 being spaced a smaller distance 30 from the surface 17 than its distance 31 from the surface 18.

The housing 10 has a recessed portion lOA and the operating part is shaped to be practically integrated into the silhouette 19 of the housing 10 and does not project beyond it in the locked position.

Figure 2:
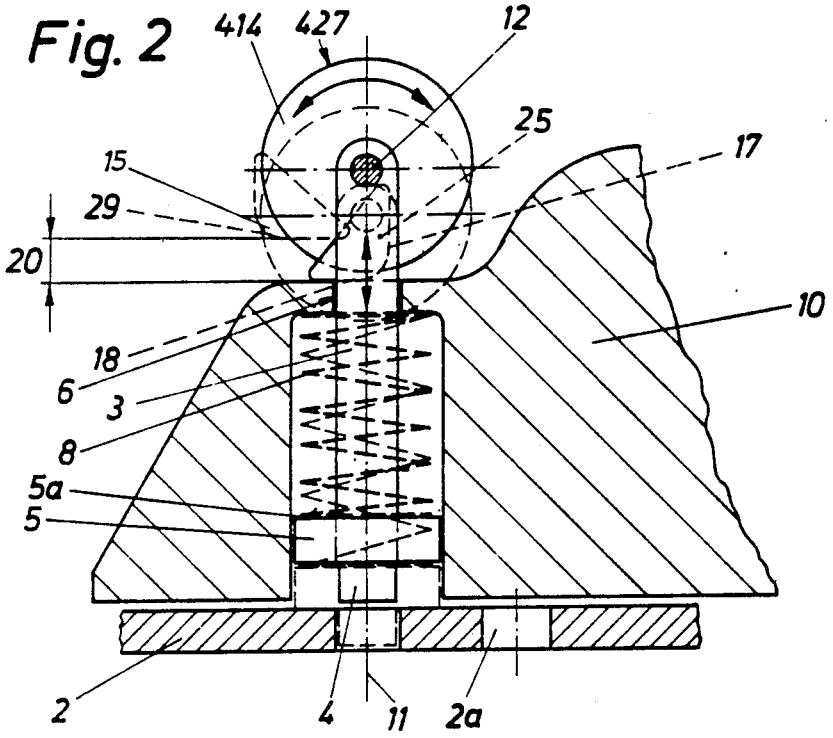
FIG. 2 illustrates a locking mechanism having a rotary-buttonlike handle part.

The most important characteristics for the functioning of the locking mechanism are thus the locking part 6, the support point or pin 12, the surfaces 17, 18 which define the eccentric vertical climb curve 15 and the handle part 14. These characteristics are also provided in the inventively designed example according to FIG. 2, whereby the design of the housing 10, the locking part 6 and the guide rail 2 is identical to the embodiment according to FIG. 1. The shape of the handle part 414 in FIG. 2 is different, namely, it is in the shape of a rotary button or roller. Further, the disengaged position in FIG. 2 is illustrated in full lines.

The surfaces 17, 18 in the FIG. 2 embodiment define also in this case the eccentric vertical climb curve 15, whereby, however, the eccentric 25 is fixedly connected as a separate structural part to the handle part 414. The amount of lift 20, which defines the difference between the engaged and disengaged positions, is here too accomplished by the different distance of the surfaces 17, 18 from the support point or pin 12. In order to move from the disengaged position illustrated in FIG. 2 into the engaged position, which is illustrated by dashes, the rotary button or the roller must be turned, which causes the eccentric 25 to slide through its eccentric vertical climb curve 15 with the support area 29 along the housing until the surface 17 rests on the upper side of the housing 10. The locking part 6 is during this operation moved in direction of the guide rail 2 by the spring 8, when the locking bolt 4 finds a locking recess 2*a*.

Figure 3:
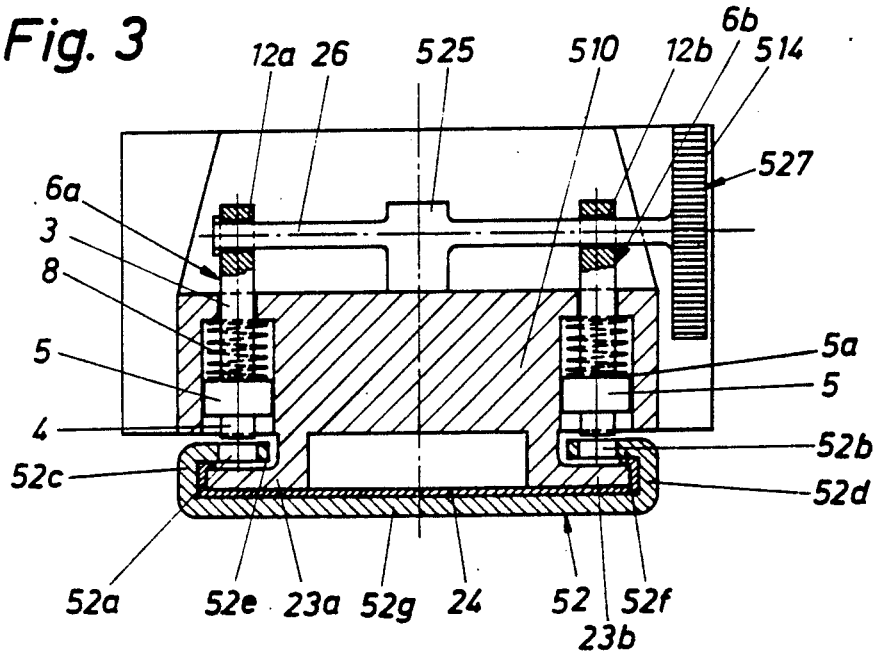
FIG. 3 illustrates a locking mechanism having two locking parts.

A slightly different embodiment with two locking parts 6*a*, 6*b* is described exemplarily in greater detail in a front view in FIG. 3, whereby an eccentric cam 525 is supported on a shaft 26, which shaft 26 extends through the locking parts 6*a*, 6*b* which are each arranged on the right and left of the eccentric cam 525 and thus defines their support points 12*a*, 12*b*. The shaft 26 projects at one side farther beyond the one support point 12*b* and carries thereat a rotary roller 514 functioning as a handle part. FIG. 3 illustrates furthermore in a more detailed form a possible development of the guide rail 52, whereby same is formed of a profiled material which has a base part 52*g* secured to the ski, and is bent vertically upwardly at its edges to form arms 52*c* and 52*d*. The arms 52*c* and 52*d* each have a segment bent farther inwardly parallel to the base part 52*g*, whereby the parts 52*e*, 52*f* have the locking recesses 52*a*, 52*b* therein. The housing 510 has feet 23 thereon, which are guidingly received in the groove formed between the parts 52*e* and 52*f* and the base part 52*g*. To improve the sliding characteristics, a sliding insert 24 is provided between the feet 23 and the guide rail 52.

Figure 4A:
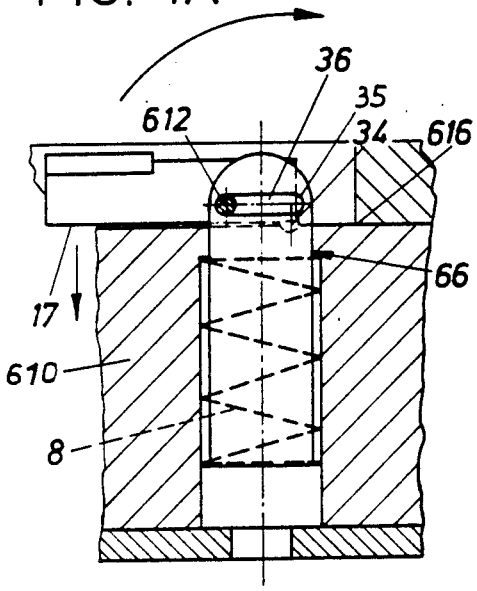
FIGS. 4A and 4B illustrate a locking mechanism having an elongated slot for the support point or pin in an engaged and disengaged state.
Figure 4B:
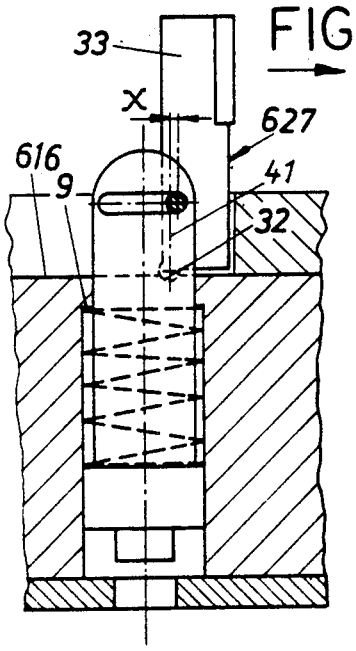

FIGS. 4A and 4B illustrate a further inventive development of the locking mechanism, in which the locking part 66 has a slot 36 therein. The support point or pin 612 is slidingly arranged in the slot 36 and is formed by a bolt which is fastened on the lever-like constructed handle part 33. The handle part 33 has a support area in the form of a spherical section 34 in a recess 32 on the upper side of the housing 37. The surface 17 is formed by the body of the handle part 33, while surface sections, which can engage the upper side of the housing 37 during the disengagement, are provided on the spherical section 34. The effect of the disengagement or engagement is here too determined by the different distance of the support point or pin 612 from the surface 17 or from the not identified surface sections on the spherical section 34. The handle part 33 stops in the disengaged position when the support point 612 goes at least with an amount X beyond a vertical plane through the centerline 41 of the support area 34. The amount X is determined by the slot 36 permitting a freeing of the support point 612 through its end 35, which projects beyond the plane.

Analogously with the embodiment which is illustrated in FIGS. 4A and 4B, the slot 36 could also be designed in a handle, whereby in this case the support point 612 would be formed by a bolt fixedly connected to the locking part 66.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a front jaw of a ski binding having a guide rail adapted to be fastened to an upper side of a ski and having support means thereon for supporting a jaw unit for movement in a longitudinal direction of said ski, said jaw unit having a housing and a locking means for locking said jaw unit in predetermined adjusted positions on said guide rail, said locking means including a locking part which is movably held on said jaw unit and a resilient means for continually urging said locking part into a form-locking selective engagement with a complementary locking recess on said guide rail, said front jaw having an operating member and means for operatively connecting said operating member to said locking part for effecting a disengagement of said locking part from said complementary locking recess, the improvement comprising wherein said housing has means defining a recessed portion therein, wherein said operating member is connected to said locking part at a support point and is provided with first and second surfaces defining an angle therebetween, each surface being spaced a different distance from said support point, said first surface engaging said housing when said locking part is engaged in said locking recess, said second surface engaging said housing when said locking part is out of engagement with said locking recess, wherein at least one of said first and second surfaces is urged into engagement with said housing by said resilient means whereby when said second surface engages said housing, said resilient means will hold said second surface in engagement with said housing and thereby hold said locking part out of engagement with said locking recess to thereby render said front jaw free to move along the length of said ski, and wherein said operating member is received in said recessed portion in said housing when said first surface engages said housing,

2. The ski binding part according to claim 1, wherein said operating member is rotatably supported on said housing, said locking part having an elongated slot therein and said support point including means received in said slot.

3. The ski binding part according to claim 1, wherein said operating member is an eccentric cam.

4. The ski binding part according to claim 1, wherein said handle ia at least one of a rotary button and a rotary roller.

5. The ski binding part according to claim 1, wherein said operating member is pivotally mounted on said housing about a spherical section, wherein said support point movably engages a substantially horizontally elongated slot in said locking part, whereby at least one end of said elongated slot is farther away from an imaginary vertical centerline of said locking part than said spherical section.

6. The ski binding part according to claim 1, wherein two locking parts are provided and are arranged on both sides of the centerline of said ski.

7. The ski binding part according to claim 1, wherein the operating member can be operated only by a tool.

8. The ski binding part according to claim 1, wherein an exterior surface of said operating member is integrated into a silhouette of said housing.

9. The ski binding part according to claim 1, wherein said operating member is pivotally supported on said housing so that in the closed or open position of said operating lever, said first or second surfaces will lie on one or towards an other side of a plane which extends through the centerline of the pivotal support.

10. The ski binding part according to claim 1 wherein said first and second surfaces are separated by a rounded area.

11. The ski binding part according to claim 9, wherein said first and second surfaces are eccentrically related relative to a pivotal support for operating member.

12. The ski binding part according to claim 1, wherein in the engaged position of said locking part, said second surface lies in a horizontal plane and said first surface lies in a vertical plane parallel with respect to the longitudinal center axis of said locking part.

13. The ski binding part according to claim 1, wherein said operating member is a handle having said first and second surfaces integrally formed thereon.

14. The ski binding part according to claim 13, wherein said handle is a one-arm lever, the one end of which is a handle part and the other end of which has said first and second surfaces thereon.

15. The ski binding part according to claim 13, wherein said handle is pivotally supported for movement on a shaft, said first and second surfaces being eccentrically related to said shaft.

16. The ski binding part according to claim 1, wherein said locking part has a piston at an end adjacent said guide rail with an abutment surfaces for said resilient means, said piston having a locking pin guided in an approximately cylindrical recess in said housing, said housing having remote from said guide rail an opposing surface for said resilient means.

17. The ski binding part according to claim 14 wherein said handle part extends from said operative connection toward the tail of said ski.

* * * * *